US008074495B2

(12) United States Patent
Kostuj

(10) Patent No.: US 8,074,495 B2
(45) **Date of Patent: *Dec. 13, 2011**

(54) WAGGLE WEIGHT AND OTHER PREPARATORY PERIOD EQUIPMENT MEASUREMENTS

(76) Inventor: William Alan Kostuj, Glendale Heights, IL (US)

( * ) Notice: Subject to any disclaimer, the term of this patent is extended or adjusted under 35 U.S.C. 154(b) by 166 days.

This patent is subject to a terminal disclaimer.

(21) Appl. No.: 12/455,916

(22) Filed: Jun. 9, 2009

(65) Prior Publication Data

US 2009/0254204 A1 Oct. 8, 2009

Related U.S. Application Data

(63) Continuation-in-part of application No. 11/261,289, filed on Oct. 27, 2005, now abandoned, application No. 12/455,916, which is a continuation-in-part of application No. 11/262,393, filed on Oct. 27, 2005, now abandoned.

(60) Provisional application No. 60/622,996, filed on Oct. 28, 2004.

(51) Int. Cl.
*A63B 53/00* (2006.01)

(52) U.S. Cl. ..... 73/65.03; 73/760

(58) Field of Classification Search ..... 73/760–860, 73/65.03

See application file for complete search history.

(56) References Cited

U.S. PATENT DOCUMENTS

| | | | | |
|---|---|---|---|---|
| 5,197,739 | A * | 3/1993 | Johnson, III | 473/271 |
| 5,470,055 | A * | 11/1995 | Ritchie | 473/215 |
| 6,039,658 | A * | 3/2000 | Cecchin | 473/269 |
| 6,705,952 | B1 * | 3/2004 | Vecsey | 473/232 |
| 6,743,111 | B2 * | 6/2004 | Mindlin | 473/218 |
| 7,063,627 | B2 * | 6/2006 | Mindlin | 473/267 |
| 7,509,842 | B2 * | 3/2009 | Kostuj | 73/65.03 |
| 7,509,843 | B2 * | 3/2009 | Kostuj | 73/65.03 |

* cited by examiner

*Primary Examiner* — Max Noori

(57) ABSTRACT

Disclosed is fitting at least one equipment measurement to a performer of a pre-determined activity to improve performance. Said equipment measurement is fitted via an analysis of pre-swing or pre-action movement or position, before the swing or action of the pre-determined activity is determined to begin. Said fitted equipment measurement may be used to fit at least one further equipment measurement as applicable based on a performance analysis of said performer. The fitting of golf equipment in such manner is particularly disclosed, including fitting a golf club measurement of a pre-swing rotation point location (waggle weight point) and using said measurement to further fit a golf club measurement (waggle weight) about said rotation point location based on golfer performance. Disclosed is making golf clubs or other equipment using the at least one fitted equipment measurement. Also disclosed is the producing and using of devices to aid in fitting said equipment measurement(s) and making said equipment, including a test golf club to aid in measuring a golf club pre-swing rotation point location and a waggle weight scale with a fulcrum, its fulcrum placed at a location corresponding to a fitted golf club pre-swing rotation point location.

20 Claims, 7 Drawing Sheets

WAGGLE WEIGHT AND OTHER PREPARATORY PERIOD EQUIPMENT MEASUREMENTS

This application is a continuation-in-part of prior application Ser. No. 11/261,289, filed Oct. 27, 2005 now abandoned, which claims the benefit of provisional Application No. 60/622,996, filed Oct. 28, 2004, and also a continuation-in-part of prior application Ser. No. 11/262,393, filed Oct. 27, 2005 now abandoned, which claims the benefit of provisional Application No. 60/622,996, filed Oct. 28, 2004.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

TECHNICAL FIELD & BACKGROUND

The present invention generally relates to the fitting of equipment used by a performer during a determined activity. The focus of the present invention is on equipment measurements that can and should be fit during a preparatory period of the determined activity in order to obtain one's best performance at the activity. More specifically, the present invention is described in terms of fitting golf club specification measurements to golfers during the pre-swing period, before a golf swing ever starts. The primary focus of the present invention is a waggle weight specification measurement as applied on golf clubs, which includes a golf club rotation point location that can only be determined during a pre-swing. As noted, however, the scope of the present invention extends well beyond golf and may be applied to multifarious activities, including sporting and non-sporting in nature.

There is a constant search in the golfing industry to find new ways to help increase the performance of golfers. The present invention delivers enhanced performance by providing higher quality feedback to golfers from golf clubs.

A swing is any movement begun with a conscious intent to strike a golf ball or simulated golf ball. A pre-swing starts with any thought or action to prepare for striking the golf ball or simulated golf ball and ends with the start of the swing. An address is a portion of the pre-swing initiated when taking one's stance over the golf ball and ended with the start of the swing.

In more general terms that can also be applied to other activities, where a backward and a forward action take place with no prolonged period of stoppage between the backward and forward segments, then the start of the backward action is generally defined as being the beginning of an activity's performance. Activities of this type typically include but are not limited to golf and tennis strokes and the swinging a hammer tool. In tennis, because a tennis ball must often be, yet often not, be run after before making a stroke with a tennis racket, such travel cannot fundamentally be considered part of a tennis stroke.

In other activities such as swinging a baseball bat, where a notable period usually elapses between moving the bat backward for the purpose of creating a batting stance and swinging it forward, then the beginning of the forward swing is generally defined as the start of the activity's performance. All that takes place before the defined start of an activity is defined as the preparatory period of the activity. Terms including "preparatory period," "pre-swing," and "pre-action" may be used synonymously to indicate that which takes place prior to the defined start of an activity's performance unless the context dictates otherwise. Because of a large number and wide variety of activities and associated equipment for which the present invention may be implemented, reasonable adjustments might be sensible for certain activities regarding when a preparatory period is specifically defined as ending and when an activity's performance is defined as beginning.

A waggle is a motion performed during a golf pre-swing that contributes feedback to a golfer regarding a golf club about to be swung. A waggle usually produces a rotation point about a golf club, named a waggle weight point. The effect of such rotation can result in an effective club head weight (could also be interpreted as an effective golf club total weight) sensed by the golfer when performing a waggle. This effective, dynamic weight sensed during the pre-swing, named a waggle weight and which may provide a substantially different sensation from that of a golf club's actual total, static weight, can greatly impact on one's setup and subsequent golfing performance.

One area of difficulty that prevents the accomplishment of higher quality feedback for making more precise golf clubs is the continuing use of traditional swing weighting. Swing weight scales use a previously decided fulcrum position, almost always fourteen inches, rarely twelve, from the grip end of a golf club, to make golf clubs to particular swing weights. The problem is the current swing weighting system is a one-size-fits-all attempt to balance and match various golf clubs to different styles of golfers.

For many golfers swing weight does not work effectively. The present invention positions a fulcrum at a determined waggle weight point. Golf clubs can now be produced based on waggle weight. Waggle weight is an alterable, measurable golf club value instituted when a golf club is placed against a fulcrum located at a waggle weight point. Once a waggle weight point is determined based on pre-swing movement, an assessment to determine a waggle weight measurement can take place based on the waggle weight point position. Upon finding a preferred waggle weight value, any golf club can be produced with the determined measurement for the purpose of improving golfer performance. The waggle weight specification may be used on any type of golf club, including but not limited to traditional designations like woods, irons, and putters. Pre-swing perceptions and measurements of golf club characteristics other than "waggle weight," which can also notably influence one's setup and subsequent golfing performance, may also be determined using the present invention. Thus, golf clubs can henceforth be better made to help improve the performance of golfers more than has ever been possible before.

The waggle weight specification is not limited in its use to a golf-specific application. Any activity, whether athletic or non-athletic, where any "pre-swing" or "pre-action" movement may be performed prior to and in preparation for the generally accepted start of the action, may be able to have the waggle weight specification applied. Use of the waggle weight invention may aid in improving the fitting of a variety of equipment used in a variety of activities to a variety of performers.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF ILLUSTRATIVE EMBODIMENTS

Embodiments of the present invention include, but are not limited to, a waggle weight point disposed about a golf club and the golf club having a waggle weight measurement, a waggle weight scale with a fulcrum, a method for establishing a waggle weight point, determining a waggle weight, and producing at least one golf club with the waggle weight, a computer-implemented process for locating a waggle weight point, and systems for locating a waggle weight point, determining a waggle weight, and generating at least one golf club with the waggle weight specification.

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention, however, the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising," "having," and "including" are synonymous, unless the context dictates otherwise.

Figure 1A:
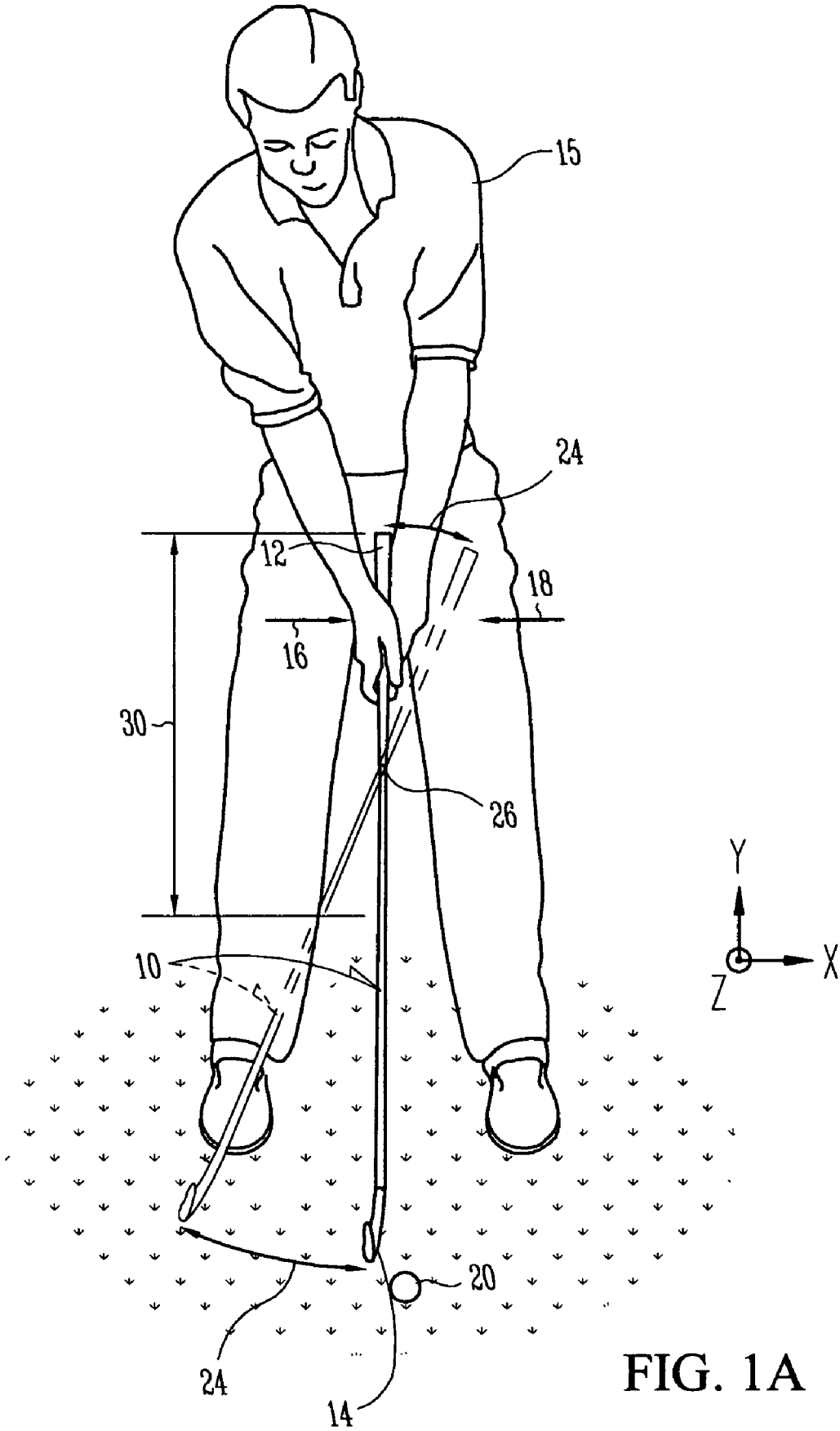
FIG. 1A illustrates a drawing of a golf club and a golfer, in accordance with one embodiment of the present invention.

Referring now to FIG. 1A, in one embodiment, three dimensions X, Y, and Z are shown. Illustrated is a golf club 10 having a grip end 12 and a club head end 14. Also portrayed are a first force 16 and a second force 18 that are applied to the golf club 10 by a golfer 15, thereby creating one common form of waggle movement. The pre-swing, address and any waggle or waggles occur while preparing to hit a golf ball 20, before the golfer 15 begins a swing. Some golfers might waggle only once prior to starting their swings, while others may repeat the maneuver many times ahead of attempting to strike the golf ball 20. A waggle motion habitually produces a rotation 24 of the golf club 10 about a waggle weight point 26. The waggle weight point location 26 may be specific to each golfer 15 and can vary substantially from golfer to golfer based on individual pre-swing routines. All golfers' waggle weight points will lie within a waggle weight point range. The waggle weight point range shown 30 could be a range from the grip end 12 (0 inches) to the mid-point of the golf club's 10 length and may be considered a reasonable waggle weight point range based upon the history of golf. However, a waggle weight point location may occur anywhere about a golf club. During any given period of time, a golfer's waggle weight point may generally be located in the same approximate area relative to the grip end 12 of a golf club, regardless of the overall length of the golf club.

Figure 1B:
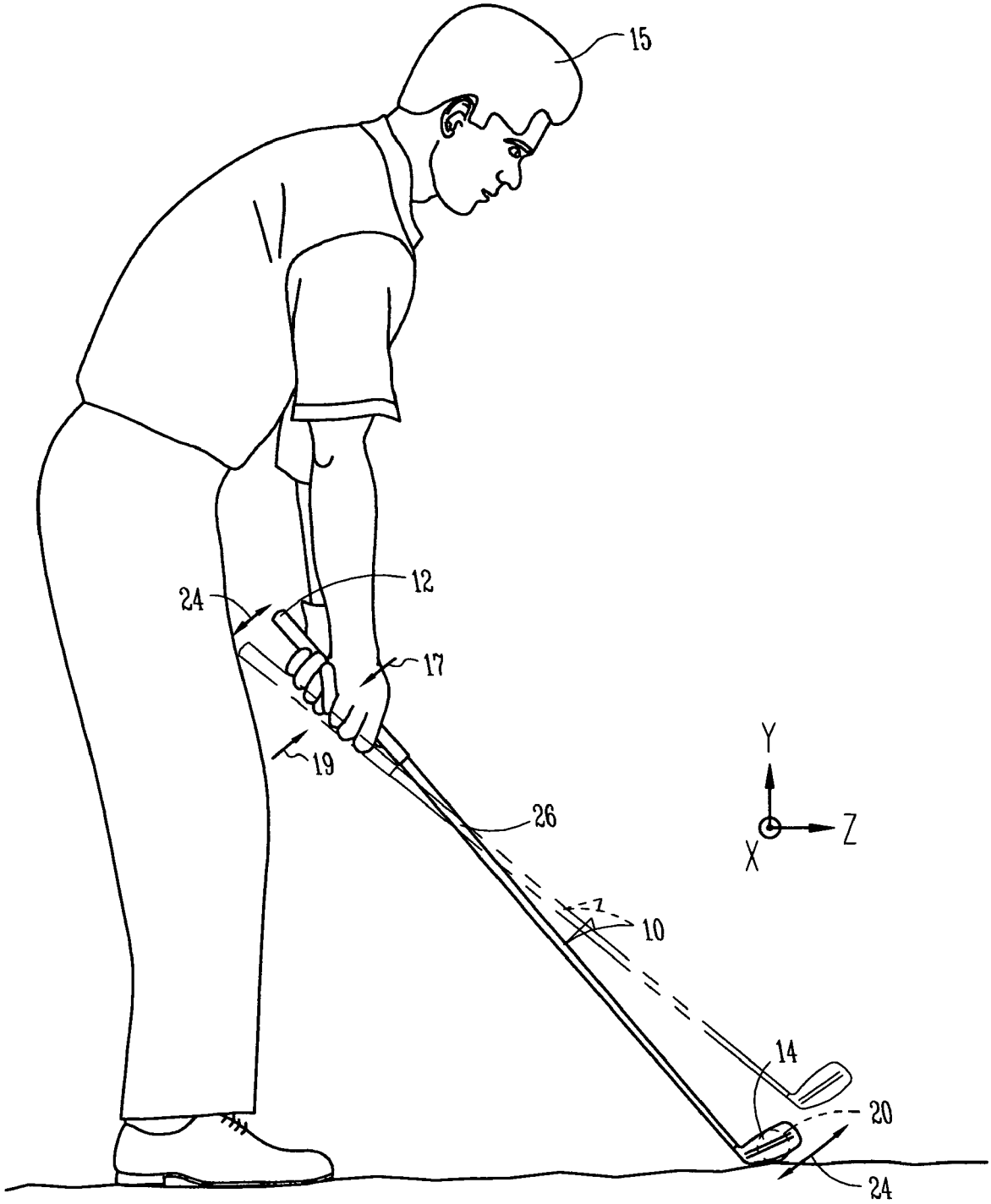
FIG. 1B illustrates another drawing of a golf club and a golfer, in accordance with one embodiment of the present invention.

Referring now to FIG. 1B, in one embodiment, three dimensions X, Y, and Z are shown. Illustrated are a golf ball 20 and a golf club 10 having a grip end 12 and a club head end 14. Also portrayed are a third force 17 and a fourth force 19 that are applied to the golf club 10 by a golfer 15, thereby creating another common form of waggle movement. Gravitational energy about the golf club may be felt by the golfer in the course of such movement. Waggle motions habitually produce a rotation 24 of the golf club 10 about a waggle weight point 26.

While the embodiments portrayed in FIGS. 1A and 1B could each be the all-inclusive waggle styles of two different golfers, the two depictions may also represent individual segments of a more comprehensive waggle of a single golfer, with movements shown in FIGS. 1A and 1B that could occur during different time frames. Waggles, therefore, can have three-dimensional components, with rotation points (point positions could be in the same place or different locations) that may be observable and analyzable from different planes of view as well as at different times during a golfer's pre-swing. Waggle movements, including those portrayed in FIGS. 1A and 1B, can involve the entire body and may also contain other golf club motion ingredients such as vertical, horizontal, and even circular movement. Other forms of pre-swing waggling can occur and be completed even before a golfer begins to address a golf ball, yet still ultimately affect golfing performance equally to that of address waggling.

Figure 2:
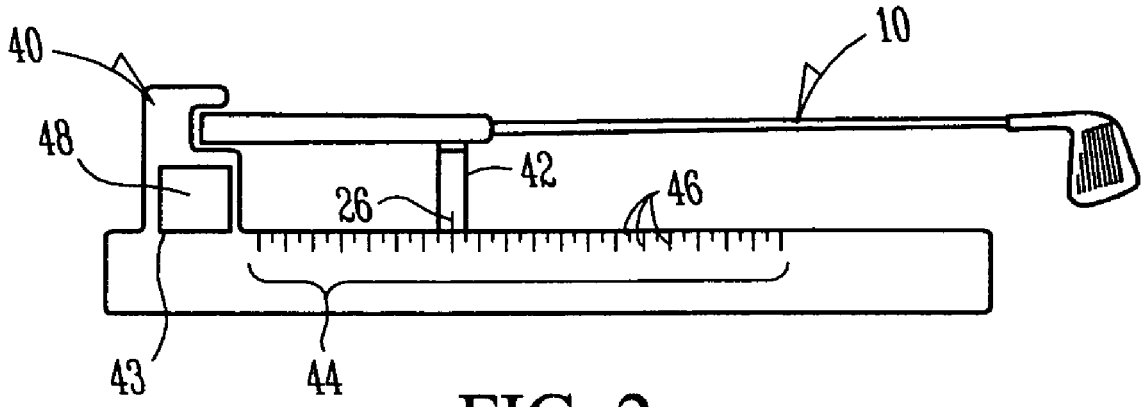
FIG. 2 illustrates a drawing of a waggle weight scale with an electronic display, in accordance with one embodiment of the present invention.

Referring to FIG. 2, in one embodiment, illustrated is a waggle weight scale 40 with a fulcrum 42 and an electronic display 43. The fulcrum 42 may be permanently fixed at one point or may be variable. It is understood that the electronic display 43 could be placed on the waggle weight scale 40 or the electronic display 43 could be in any other location such as remotely connected that would operably couple the electronic display 43 to the waggle weight scale 40 while allowing an operator to view the electronic display 43 conveniently. The fulcrum 42 may be set to the waggle weight point 26 of FIGS. 1A and 1B, assuming identical locations for the waggle weight point 26 in both figures. For variable fulcrum waggle weight scales, a waggle weight rule 44 may be included. The rule 44 can have increments 46 to allow the fulcrum 42 to be set at a position that corresponds to the waggle weight point 26 location. The waggle weight rule 44 may have increments 46 to each 1/32nd of an inch or 1 millimeter. The electronic display 43 will read out a value that is equal to the waggle weight 48 of the golf club 10. The waggle weight 48 of a golf club 10 can be modified, often by, though not limited to, altering the club head weight of the golf club 10. Waggle weight scale pre-programming may be supplied in order to provide an appropriate range of waggle weight balance readings at each accessible waggle weight point fulcrum location.

Successive values of swing weight on past swing weight scale designs are distinguished by changes of one eighth of an ounce of weight deviation on the very end of a golf club at the grip side for the standard, fourteen-inch, fixed-fulcrum scale model, over a range of generally 11½ through 19 ounces. Variations of one tenth of an ounce, usually throughout a range of 0 to 28 ounces, characterize consecutive readings on the twelve-inch, static-fulcrum model, called the Official Scale. The lower numbers on the Official Scale are conventionally used for measuring the gross weights of individual golf club components or assembled golf clubs and are not ordinarily used for swing weighting. The foregoing figures can be considered for a waggle weight scale configuration, or an entirely new format may be developed as desired. Addressing this particular design feature could warrant initially matching a test group of golfers to their respective waggle weight points. Additional research might then be conducted regarding how much change in golf club balance about the players' respective waggle weight points needs to take place before a difference in performance is observed. It may be discovered that weight change statistics concerning waggle weight do not coincide with values chosen for previous golf club balancing scales, thus promoting design revision in this area.

Figure 3:
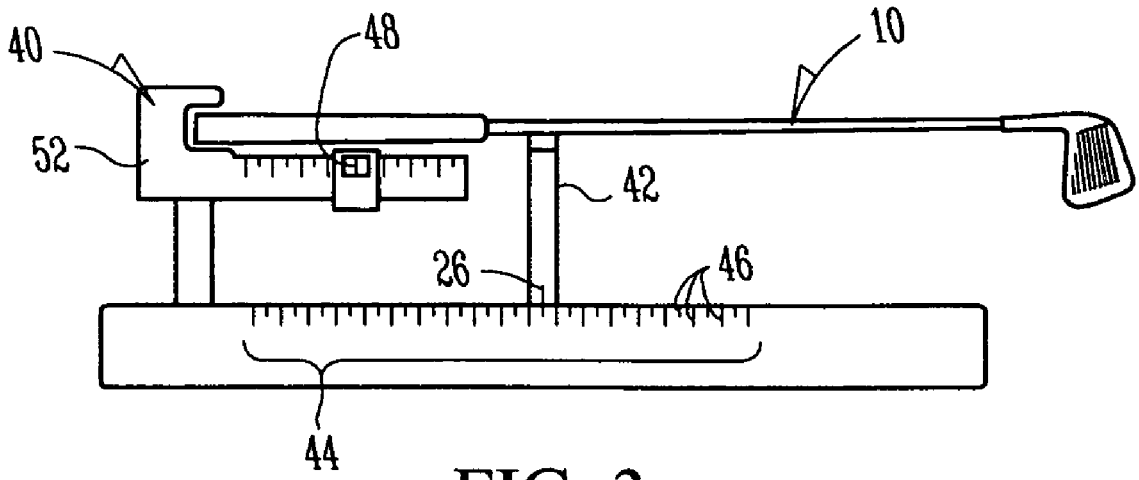
FIG. 3 illustrates a drawing of a waggle weight scale with a mechanical display, in accordance with one embodiment of the present invention.

Referring to FIG. 3, illustrated is another embodiment of a waggle weight scale 40 with a fulcrum 42 and a mechanical balance 52. Again the fulcrum 42 may be set to the waggle weight point 26 of FIG. 1A and FIG. 1B, assumed to be at like positions in both depictions. A waggle weight rule 44 may be included with variable fulcrum waggle weight scales and can include increments 46 to allow the fulcrum 42 to be conveniently and precisely set at a position that corresponds to the waggle weight-point 26 location. The mechanical balance 52 might be alterable (by weight as one example) in order to provide suitable waggle weight values as the fulcrum position varies. A reading that is equal to the waggle weight 48 of the golf club 10 is determined by sliding the movable weight (surrounding the waggle weight reading 48 and which may also be alterable) until the golf club 10 is balanced on the fulcrum 42.

Notwithstanding perhaps the inclusion of waggle weight point location information as part of a waggle weight value, balance-changing unit designations on a waggle weight scale 40 may be formatted to any used for previous swing weight scale designs, such as ounces, grams, or inch-ounce numbers represented by assigned letter-number labels including C-5, D-2, and E-0, or a completely new measuring scheme can be devised. Each available waggle weight point position may have its own distinct formulation for defining and designating waggle weights. Consequently, variable-fulcrum waggle weight scales might incorporate appropriate designs to achieve scale recalibrations throughout the accessible waggle weight point range.

The waggle weight of a golf club may be figured by manual calculation in lieu of a waggle weight scale. For each individual golf club, a balance point can be located as a spot where a fulcrum is positioned when the golf club rests perfectly horizontal on the fulcrum. A total weight of the golf club is measured at this center of gravity location, and a distance is determined from this same point to the very end of the golf club at the grip side. From this length is subtracted a decided waggle weight point, which may also be a distance from the grip end of the golf club. The difference is multiplied by the above-measured weight in order to obtain a rotational force, or torque, existing at the waggle weight point. If the lengths are measured in inches and the weight in ounces, the calculation result will be in units of inch-ounces. Inch-ounce numbers can be referenced against designations that may be developed for waggle weight values in order to obtain the waggle weight of the golf club. Dividing an inch-ounce figure by the waggle weight point distance can reveal the exact amount of weight required to be placed on the very end of the golf club at the grip side in order to balance the golf club in equilibrium when the club is resting level on a fulcrum at the waggle weight point, for which reference material may also be made available. This waggle weight calculation, and the scales portrayed in FIGS. 2 and 3, may indicate the gravity (vertical) force component(s) felt by a golfer when waggling, characterized by a sensation of operative golf club head weight or total weight and more closely depicted by forces 17 and 19 in the movement of FIG. 1B. If lateral pre-swing energies (more closely associated with FIG. 1A and forces 16 and 18) and/or any other energies developed and/or felt during waggling are deemed to be as crucial or even more so toward subsequent swing performance, then other apparatus to measure such forces around waggle weight points and help make golf clubs accordingly can be devised/utilized as desired.

Devices like waggle weight scales but for determining similar equipment measurements existing during preparatory periods in other activities and/or for determining other equipment measurements existing during preparatory periods in golf and/or other activities may be produced and used. Such devices might also utilize fulcrums and/or determine other preparatory period measurements and have means to secure the equipment used in the activity when measuring.

Figure 4:
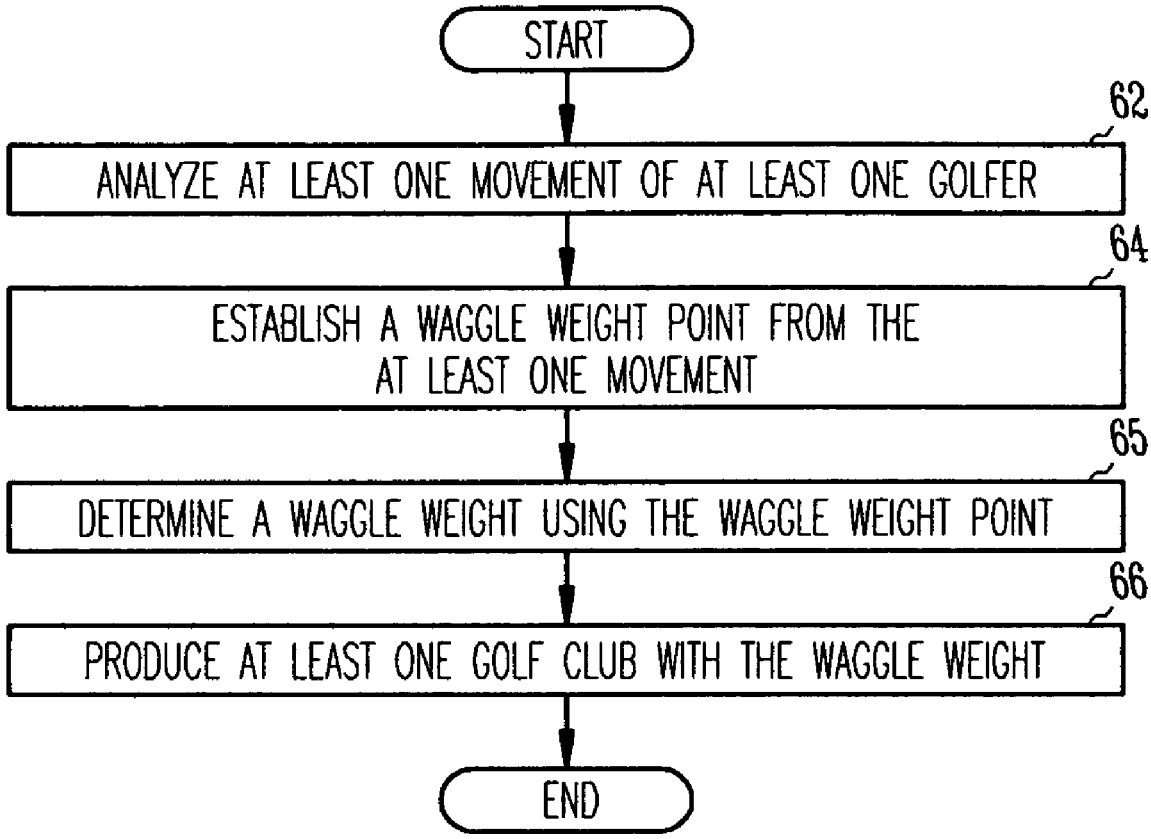
FIG. 4 illustrates a flow chart of a method, in accordance with one embodiment of the present invention.

Referring to FIG. 4, in one embodiment, illustrated is providing a method to produce golf clubs with a waggle weight. Shown are analyze at least one movement of at least one golfer 62 and establish a waggle weight point from the at least one movement 64. A waggle weight point location might be positively ascertained through the use of a computer-implemented process. An attempt to locate a waggle weight point position may also be made by human observation. Forasmuch as waggle weight points are found out from information acquired before a swing is begun, the hitting of golf balls and even golf club swinging may not be essential in order to succeed at finding waggle weight point locations. Establishing the preferred waggle weight point location might be based on the pre-swing waggling motion of a single player, or the point's position could be an average of multiple findings conducted within appointed golfer categories. In cases where perhaps different planes of analysis, separate waggles, and/or other factors may reveal variant waggle weight point locations even for the same individual, further investigation might be initiated to determine which waggle weight point and its associated pre-swing action is most crucial to the golfer's subsequent performance, selected results could be averaged, or the waggle weight method may be applied to more than one point location. Also depicted is determine a waggle weight using the waggle weight point 65. It may be desired to not reevaluate for a waggle weight point location each time a waggle weight is determined, in which case the waggle weight point used may be a previously decided point position from a former probe. Golfing performance might then be evaluated at various golf club waggle weight measurements about the placed waggle weight point. A preferred waggle weight may be selected. The waggle weight choice could be secured by the analysis of a specific golfer, or the decision might be supported by a larger study. Waggle weight readings can be obtained by using a waggle weight scale. Waggle weight values may also be manually figured. Subsequently shown is produce at least one golf club with the waggle weight 66.

A "golfer representation" may be used in place of or in addition to a real golfer, said representation of which might be a video reproduction or a computer simulation of golfer pre-swing/swing movement, not limited to these possibilities.

Multiple golf clubs produced into what may commonly be referred to as a set or matching set, made for instance to successive half-inch length increments and having other coordinated components/features, can exhibit different playing characteristics when applying waggle weight in comparison to traditional swing weight. When matching golf clubs using the long accepted fourteen-inch swing weight scale, an increase of approximately seven grams of head weight for each successively shorter golf club is required. For matched waggle weighted clubs, however, waggle weight point locations longer than fourteen inches may need an increased slope of head weights, for example nine grams per club head, as the set progresses in the same half-inch length increments. Shorter waggle weight point distances can require a shallower slope of head weights throughout the set, thereby producing club head weights and total golf club weights that become more equal to each other as one's waggle weight point location moves toward zero. Zero may apply to those who perform no pre-swing activity. In addition to new club construction, the waggle weight method can also be applied on existing golf clubs.

Figure 5:
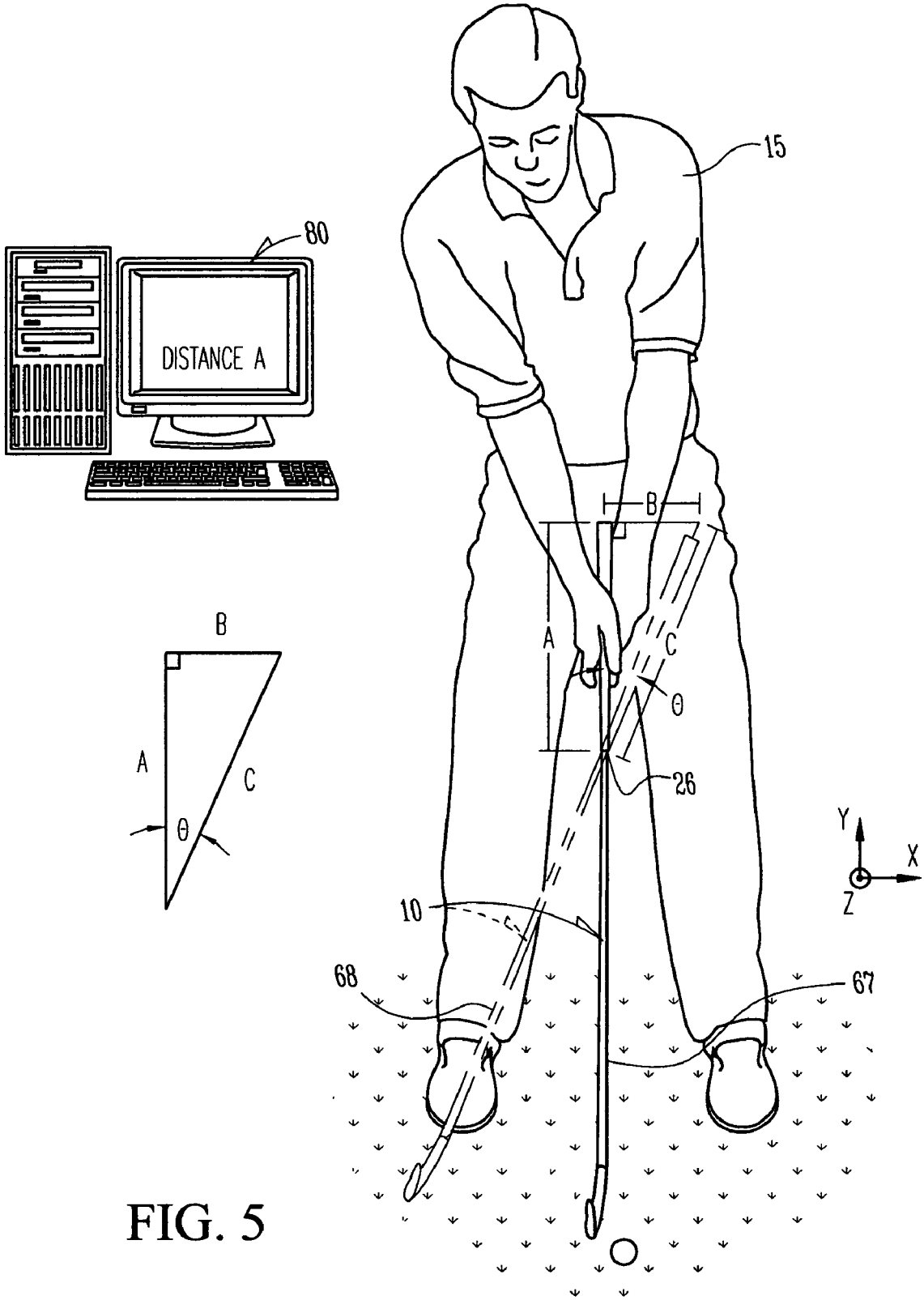
FIG. 5 illustrates a drawing of a golf club, a golfer, and a computer-implemented process, in accordance with one embodiment of the present invention.

Referring to FIG. 5 is, in one embodiment, a computer-implemented process for calculating the location of a waggle weight point 26. Illustrated are dimensions X, Y, and Z. Due to the complexities of golfers' waggle motions, computer implementation to aid in locating waggle weight points more precisely and consistently is significant toward effective golf club waggle weighting for golfers. The process comprises collecting golf club motion data and locating a waggle weight point 26 from the data. A waggle weight point 26 may correspond to a fulcrum rotation point developed during a pre-swing and can be calculated by a computer 80. Shown is a first waggle position 67 where data can be collected. Data may also be gathered at a second waggle position 68. In calculating the waggle weight point 26 location, the waggle weight point 26 can be equal to a distance A. Computer-generated vectors may be created as golf club substitutes to produce a right triangle ABC. Where angle θ may be an angle between the first waggle position 67 and a second waggle position 68. Where B can be a distance between the first waggle position 67 and the second waggle position 68 and is at a right angle to A. Where A may be calculated as $A=B/\tan\theta$. Tangent solutions for angles are widely available from mathematical source material. Automated calculation of waggle weight points can be rendered using a primary computer-implemented process by design. Exceeding that, it may be desirable to compose a more detailed computer-implemented process that might analyze, save, and reproduce additional relevant golfing action to provide a greater depth of understanding and more usefulness than can be realized with just a basic computer-implemented process. One example could be a pre-swing first saved as data and then exhibited in slow motion video, whereby with such a tool a waggle weight point might be obtained, studied, and explained in a more manual manner if desired, yet with considerable precision due to the decisive computer-implemented process. Furthermore, the saved data can be referenced against any past/future examination in order to monitor for changes in pre-swing movement and/or waggle weight point location. In consequence, a computer-implemented process to aid in locating waggle weight points might also be utilized for perhaps research and teaching purposes.

A "golf club substitute" is defined as any means to help locate a golf club rotation point during pre-swing movement. A golf club substitute may take on many forms. One example may be a club with circuitry capable of sending pre-swing club movement data to a computer for further analysis. Another may be a computer-generated vector created and linked to a video representation of pre-swing golf club movement, whereby one or more vectors might be generated and placed at various pre-swing positions to aid in locating a pre-swing rotation point. Yet another example might be a straightedge-type device to sight along the edge of and reference against pre-swing movement to help in locating a rotation point. Like in many other activities, movement, including pre-swing movement, can be performed using only the limbs of one's body, and locating a pre-swing rotation point may be accomplished under this condition. In this circumstance, a "golf club substitute" may comprise only a single point of reference about a golfer. Using FIGS. 1A and 1B for reference, before any pre-swing movement is made a reference point location about a golfer 15 might be determined that may move correspondingly to a grip end of a golf club during pre-swing movement if a golf club were used. A point location along the edge of the golfer's arm as close as possible to where the grip end 12 of a golf club would regularly be positioned might be used as one example. Subsequently, the determined reference point could be followed during golfer pre-swing movement even in the absence of any golf club. A computer-implemented process might be used to aid in following the reference point more precisely. Following the reference point may produce movement in the form of an arc 24. A radius point location 26 of the formed arc, which might correspond to a pre-swing golf club rotation point location, may be determined from the arc dimension(s). The mathematical equation for determining the location of the radius point of an arc is widely available in mathematical reference materials. Locating a pre-swing golf club rotation point through the occurrence of a pre-swing arc may also be accomplished when a golf club, test golf club, or other type of golf club substitute is used to aid in locating the pre-swing golf club rotation point. In such cases, an actual point determined to be the grip end of the golf club, test golf club, or golf club substitute may be followed rather than having to separately determine a reference point location.

With scientific means now available to more accurately determine golfers' waggle weight points than could be accomplished by human observation alone, once done a computer-implemented process may also be subsequently applied to help determine golfers' waggle weights, based perhaps on the swing timing and/or other determined characteristics of one or more analyzed golfers.

Figure 6:
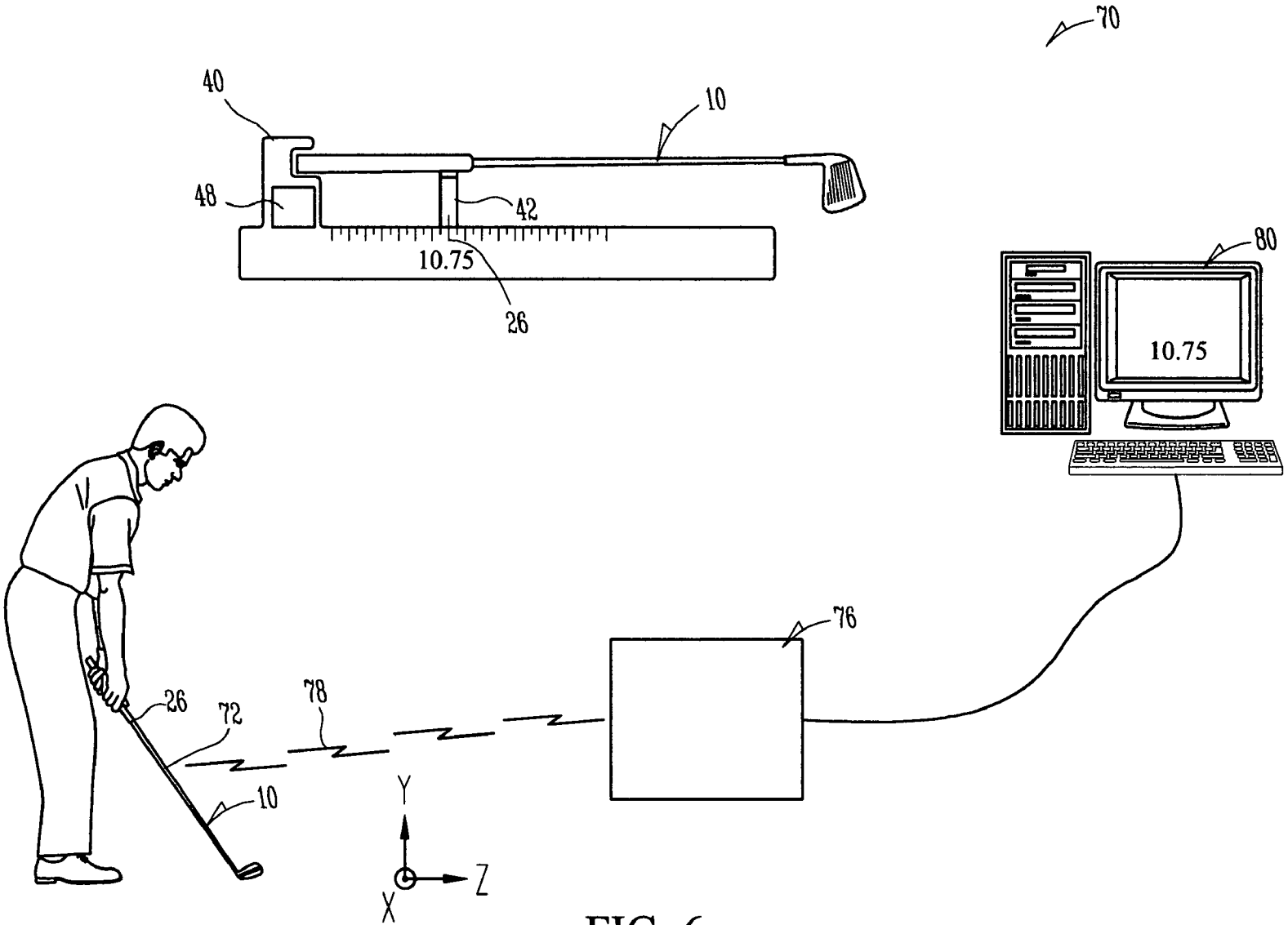
FIG. 6 illustrates a system to produce a golf club with a waggle weight, in accordance with one embodiment of the present invention.

Referring to FIG. 6, in one embodiment, a system 70 is illustrated to locate a, waggle weight point 26 and determine a waggle weight 48. Three dimensions X, Y and Z are shown. A golf club 10 might be outfitted with at least one transmitter 72 that may be capable of presenting adequate information to position a waggle weight point, whereupon the golf club 10 could be a first test golf club. The transmitter(s) can likewise be placed on the golfer being tested if appropriate, on the golfer's hand(s) for example that may be covering up part of the first test golf club that might need to be analyzed. The transmitter(s) 72 may supply at least one signal 78 for tracking movement of the golf club 10. If the signal(s) 78 from the transmitter(s) 72 cannot be directly analyzed by a computer 80, at least one receiver 76 can be employed that could acquire and format the signal(s) 78 from the transmitter(s) 72. The computer 80 intakes information from the receiver(s) 76 and may utilize a computer-implemented process to decipher the location of a waggle weight point 26 disposed about the golf club 10 during the golfer's pre-swing waggle or waggles. A scale 40 with a fulcrum 42 has its fulcrum 42 set to the waggle weight point 26 location. When the fulcrum 42 is placed at a position that corresponds to the waggle weight point 26 position, a waggle weight 48 can be derived on a golf club 10. Waggle weight 48, which is alterable, may then be analyzed. Given is determining a preferred waggle weight. This could be accomplished by using a golf club 10, thereupon the golf club 10 might be a second test golf club, and the scale 40 with its fulcrum 42 set at the waggle weight point 26 position. Various waggle weight values can be tried and rated pursuant to the golfer's performance. This would customarily be completed through the hitting of golf balls and scrutinizing of ball travel characteristics, the quality of golf club/ball contact, information obtained concerning swinging performance, and more. A computer-implemented process may also be designed and utilized for waggle weight determination in order to obtain more scientific results if desired. A favored waggle weight 48 may be selected. Accordingly provided is at least one golf club produced with the determined waggle weight. All types of golf clubs could be formed to the golfer's, or any golfer's, determined waggle weight in order to better fit the specific movement of individual players.

First and second test golf clubs may take on several forms. For example, a first test golf club, which could be used for waggle weight point ascertainment, might be nothing more than a golfer's own personal club with at least one portable sensor means temporarily attached to the club, capable of determining or aiding in determining the location of a waggle weight point. Alternately, a specialized golf club or golf-club-like device may be fabricated that can be used for waggle weight point location detection in which at least one sensor could be permanently coupled to the club/device with relevant information such as sensor location(s) and club/device length pre-programmed into a computer process. A club/device having at least one external sensor means focused on it from a distance to determine a waggle weight point location could also be considered a first test golf club. Regarding a second test golf club, what might be exploited to determine a waggle weight, a golfer's own personal club may again be used and in fact it could be the identical golf club utilized as a first test golf club if it is suitable for both assignments. However, typical completed golf clubs usually do not allow for head weights to be adjusted downward enough to enable an acceptable testing range of waggle weight values, and even when possible a common procedure of adding and removing adhesive lead tape to club heads in order to change waggle weight values can be awkward and time consuming. Therefore, a distinct golf club may also be designed for determining waggle weights. The club might have variable mass, changeable weights to permit convenient waggle weighting at different waggle weight point locations, as variant waggle weight points could necessitate applying differing weight magnitudes to change the waggle weight an equal amount on the same golf club. Specific weight measures may be tied to particular waggle weight point positions. Weight adjustments to alter waggle weight readings are typically made to the club head of a golf club, though not always. When not engaged in explicit duties, first and second test golf clubs might simply be golf clubs. Generally speaking, using golf clubs with overall specifications as close as possible to what is believed best for the golfer or golfers being analyzed, or in place of that knowledge what might be considered within a normal range, may avoid undesirable imprecision during testing, as well as possible golfer injury. Test golf clubs to help determine the fit and/or measurement(s) of other pre-swing and/or swing club specifications may be made and/or used as desired.

Figure 7:
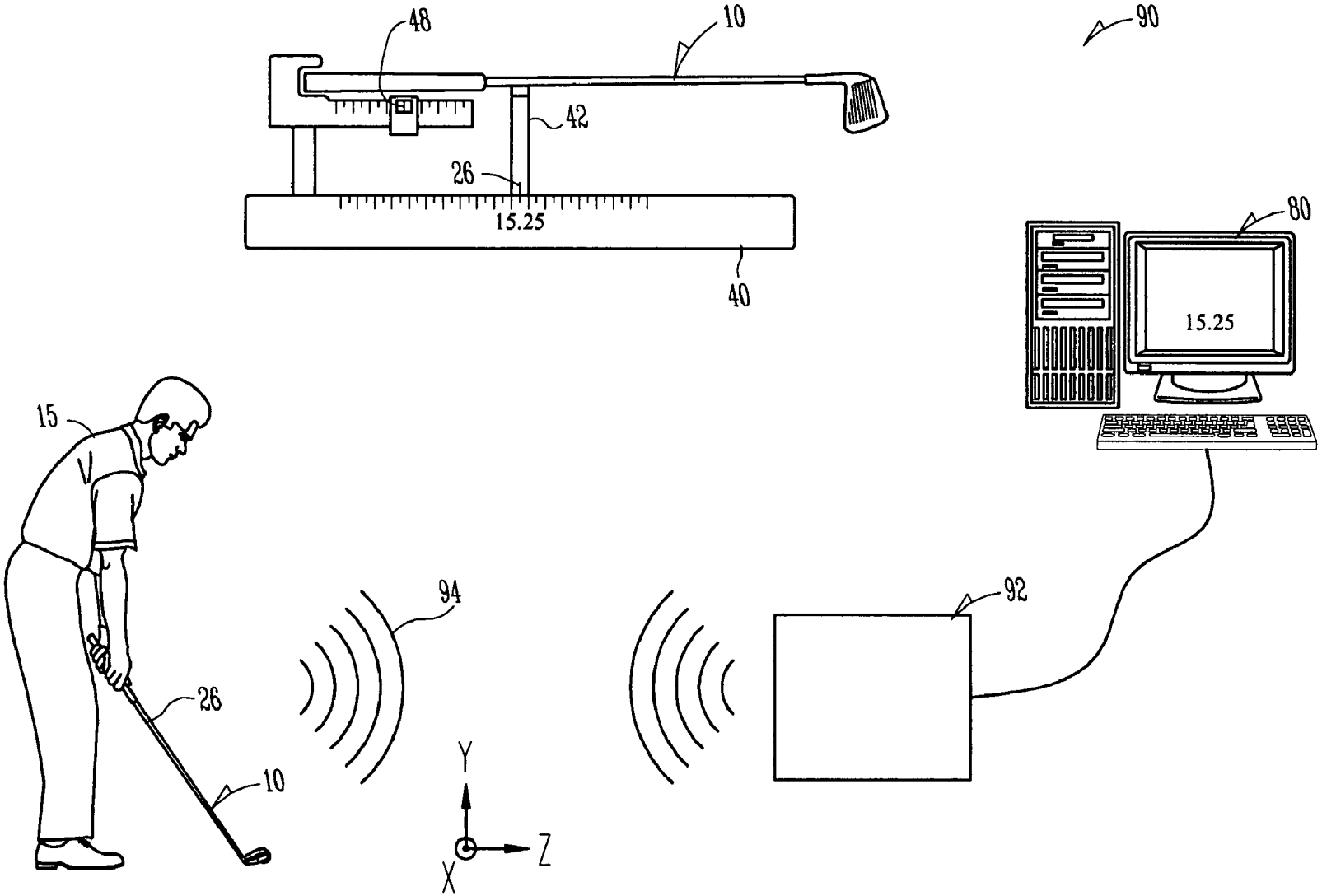
FIG. 7 illustrates another system to produce a golf club with a waggle weight, in accordance with one embodiment of the present invention.

Referring to FIG. 7, another embodiment of a system 90 to discover the position of a waggle weight point 26 and determine a waggle weight 48 is illustrated. Three dimensions X, Y and Z are shown. At least one sensor 92 is disposed about a golf club 10, at which point the golf club 10 can be a first test golf club. The sensor(s) 92 might be at least a selected one of a camera, an optical sensor, and an infrared sensor focused on the golf club 10. Note that sensor technology evolves fairly rapidly today with respect to both sensor types and/or functions, thus any desired sensor means may be designed and/or used. The at least one sensor could also be disposed about a golfer 15 if considered beneficial toward, as examples, establishing a waggle weight point and relating results more clearly. A computer 80 intakes data 94 from the sensor(s) 92 and may employ a computer-implemented process to compute the data 94 and aid in positioning a waggle weight point 26 disposed about the golf club 10 during a pre-swing. A procedure for locating a preferred waggle weight point might be repeated multiple times with different golfers if perhaps the goal is to obtain an average waggle weight point position for a more mass-produced golf club operation. A scale 40 with a fulcrum 42 has its fulcrum 42 set to a location corresponding to the selected waggle weight point 26 location. When the fulcrum 42 is placed at said location, a waggle weight measurement 48 of a golf club 10 is originated. Provided is determining a waggle weight, which is alterable. This may be achieved by utilizing a golf club 10, which during this step could be a second test golf club, and the scale 40 with its fulcrum 42 set to the waggle weight point 26 location. Different waggle weight measurements can be tested and ranked for effectiveness based on golfing performance of the player or players being investigated. A preferred waggle weight 48 may be chosen. The preferred waggle weight value might be based on but not limited to golf ball flight/roll observation after being struck, golfer feedback concerning the feeling(s) sensed in the course of swinging, and/or computer data acquired throughout golfing activity. Subsequently given is at least one golf club made to the waggle weight. A decided waggle weight could be applied to create an open-ended number of golf clubs aimed at benefiting either particular players or general player categories.

In addition to the waggle weight rotation point location, other golf club specifications that may affect any golfer's pre-swing setup and subsequent golfing performance can also be fit and measured within pre-swing movement(s) and/or position(s). Such specifications may be determined in accordance with the present invention, based solely on a pre-swing analysis, with no requirement to analyze any portion of an actual golf swing in order to fit such specifications. One example could be the face angle specification of a club head of a golf club, commonly but not always associated with wood or metal wood club head styles. The nature of golfing is such that when preparing to make a golf stroke, most golfers during address do not position the club face angle of a golf club (usually engineered into the design of many golf club heads) behind a golf ball in such a way that the face angle is at exactly the same angle as the intended line of ball flight from a succeeding golf swing. One predominant reason for this is because during a golf swing the club face is only in line with the intended line of golf ball flight for an extremely short time frame and distance, and the position of the club face when a golfer addresses a ball is notably behind the point that determines golf ball flight direction during the forward swing. One contributory reason for this circumstance is that a golfer can incur a penalty even if accidentally moving the golf ball when he is addressing the golf ball. Consequently, many (but not all) golfers (depending on individual styles), may address a golf ball with a slightly open club face, although to varying degrees. Some golfers actually prefer a closed club face angle at address. An improperly fitted golf club face angle can in fact adversely affect one's golf swing. While most clubfitters prefer to fit/adjust this golf club specification by basing it on golf ball travel results and backtracking from there, one's face angle specification can instead be chosen based on one's address positioning (not ball travel results) and fit solely via a pre-swing analysis. A golfer might aim a club down a line he intends to hit a ball along while hovering the club slightly above the ground at his preferred face angle. A measurement of the golf club (or club head) face angle relative to the intended target line may be taken. Golfer face angles are very rarely in line (square) and usually expressed in degrees open (toward the right for a right-handed golfer) or closed. The face angle specification may be chosen based on golfer comfort and/or one or more other determined criteria, and its value may be determined through only a pre-swing analysis, with no need to even begin a golf swing or golf swing analysis;

Another example is the fitting of one's golf grip size. Various sizes may cause a golfer's hands to comfortably rest more clockwise or counterclockwise on a golf grip. Such changes can also influence alterations in the position(s) of one's hands more forward or backward in one's stance during one's pre-swing address, influencing still other subsequent changes in golf club movement and/or positioning. These and/or other characteristics may be evident just by observing one's pre-swing. Thus, depending on any specifically set goal(s), one's golf grip size might also be chosen solely by way of a pre-swing analysis, with no actual golf swing analysis or any part thereof transpiring. A suitable fit of other golf club specification measurements may also be desirable and possible via an analysis of only the pre-swing period. Golf club total weight as yet another example may affect one's pre-swing in ways including but not limited to one's waggling speed and/or direction and address posture. The implementation of computer hardware and/or software within the method(s) and/or device(s) of the present invention for the fitting and measuring of pre-swing golf club specifications for golfers can help for difficult to determine measurements.

While the foregoing embodiments are detailed in terms of golfing, the present invention is not limited to the activity of golf. Preparatory movements and/or positions are carried out by performers in essentially every activity. This can include activities deemed to be non-athletic as well as athletic. Common examples of athletic activities may include but are not limited to baseball and tennis. Both of these sporting activities regularly involve preparatory movements with baseball bats and tennis rackets respectively that may produce rotation point locations about the respective equipment in similar fashion to the production of waggle weight points about golf clubs during golfer pre-swing waggle movement. As it can in golf, such rotation points and the resultant force or forces created about the rotation points may result in one or more very unique perceptions of a performer's equipment as their actual baseball swings or tennis strokes begin. Although baseball and tennis players usually have the luxury of swinging the exact same equipment time after time (unlike in golf where successive strokes are generally made with different individual clubs), it is still highly important for the future advancement and/or enjoyment of these and other activities to invent, comprehend, and be able to fit such preparatory period equipment specifications or parameters to performers and produce equipment with such measurements in the most advanced manner(s) discovered so that the best performance may be achieved by both individual performers and their associated activities as a whole.

As one example of an activity generally considered to be non-athletic, a construction worker may engage in preparatory movement with any of his tools, including a hammer. The worker may produce a rotation point about the hammer in the course of trying to obtain a feeling of one or more hammer characteristics before beginning a more forceful blow with the tool in order to perhaps drive a nail into an object. Here also, the production of such a rotation point during the worker's preparatory movement may result in one or more unique perceptions of the hammer's characteristics and may greatly influence the worker's subsequent performance with the tool. While the determination of an accurate rotation point location about athletic equipment might result in a competitive advantage to a performer, a correct hammer rotation point location and suitable balance around that point location could be an important safety issue for a construction worker, possibly making the present invention even more important for such applications. The equipment examples presented that commonly have rotation point locations produced about them during preparatory periods of performers would seem to be somewhat elongated in nature in order to permit such a circumstance of rotation about the equipment. Notwithstanding this, all sizes and shapes of equipment can potentially have rotation point locations created about the equipment during the preparatory period of a performer.

And as is the case with golf clubs, in addition to the determination of rotation point locations about equipment used by performers during preparatory movement, other equipment specifications used in other activities may also be fit and measured as desired via the preparatory movement and/or positioning of performers. Such an analysis for equipment fitting and measurement might be started and completed even before the activity is defined as beginning. As the preparatory period is the only opportunity performers have to become acclimated to any equipment used from the defined start through finish of the activity, this period is of extreme importance with respect to obtaining the best performance from performers and their associated equipment. Determining as many correctly fitted equipment specification measurements as possible for a performer during any preparatory period is a foundationally important procedure in every activity.

The making and/or use of specialized devices to help in the fitting and/or measuring of at least one equipment parameter used by performers in an activity during a preparatory period of the activity is an integral element of the present invention. Comparable in function to that of golf club substitutes or test golf clubs described earlier for aiding in determining golf club measurements during a pre-swing, appropriate devices may be produced and used for other pre-determined activities as well to help determine the fit of at least one equipment measurement in the course of preparatory period movement and/or positioning of one or more performers. Using a golf swing as an example, it might initially be thought that devices to help determine golf club measurements during one's pre-swing may not be as necessary or important as devices used to analyze and measure one's actual golf swing. But this is not the case. In fact, such aiding devices may be considerably more critical to apply during a pre-swing preparation period than during the performance of an actual golf swing, and without such aiding devices the present invention may be substantially more difficult to implement effectively. Unlike many aspects of golf swings and other activities, where clear and obvious characteristics can often be noted even without the aid of modern video and/or computer-implemented techniques as examples for analyzing golf swings, many movements and/or positions encountered during one's preparatory period can be very minute or subtle and yet quite complex, and all but impossible to solve to a critical degree of precision by using only human senses. The facts are that golf club swing weighting has now been around for about eighty years, the system's accepted fourteen-inch fulcrum point location is related to a pre-swing rotation point location produced by a number of golfers (though with all due respect the original inventor[s] of swing weighting did not demonstrate any knowledge of this relationship), and virtually no one over this eighty-year time span has discovered that the fourteen-inch dimension is related to the pre-swing. These facts indicate how obscure pre-swing movement in golf can be and how crucial it is to integrate specialty devices within the present invention such as golf club substitutes to aid in locating pre-swing golf club rotation points for golfers.

In addition to helping to accurately locate (and justify) pre-swing golf club rotation points, the same and/or at least one other specialized device may be produced to also help fit and measure other pre-swing golf club specification values for golfers, like that of the club or club head face angle described earlier. Just as precisely determining the locations of pre-swing golf club rotation points, other pre-swing golf club specifications for one or more performers may also be very difficult to accurately determine by using only human senses. Thus, here again, without the accuracy and justification afforded by the implementation of such specialized devices (which often integrate computer-implemented hardware and/or software), the present invention may be more limited in its effectiveness.

For the reasons mentioned, it is also crucially important to produce and/or use the most up-to-date, computer-implemented hardware and/or software when implementing the present invention. The present invention may be less effectual with regard to its desired goals without the aid of such computer-implementation.

And just as in golf, precise equipment specification values for performers during the movement(s) and/or position(s) of the preparatory period of any other given activity may also be extremely difficult to fit and measure without the aid of supplementary specialized devices. Thus, one or more such specialized devices may be devised, produced, and utilized as desired to fit the need(s) of precisely determining sought after equipment parameters existing during the preparatory movement(s) and/or position(s) of at least one performer of any pre-determined activity other than that of golf. Such specialized devices may include but are not limited to devices similar to test golf clubs or golf club substitutes as used in golf (however able to be used for accurate, determined equipment measurement[s] during the preparatory period of the determined activity). Equipment measuring devices similar to waggle weight scales used in golf (but suitable for conveniently measuring pre-determined equipment specifications existing during preparatory periods of other determined activities and as used by performers in performing said other determined activities) may also be produced and/or utilized as desired.

In golf, as in other activities, the nature of preparatory movement(s) and/or position(s) by a performer of any determined activity, and as a result consequent equipment specifications, can be substantially different than the nature of what takes place during an actual performance of a determined activity. As such, the nature of any specialized test device(s) produced for the purpose of helping to determine performer equipment measurements existing only during a preparatory period for a determined activity may also be substantially different in nature from any test device(s) produced in order to aid in determining performer equipment measurements based on the performance of the actual activity. Defined earlier, the actual performance of an activity does not begin until after the point when the preparatory period is completed. To explain one major difference, any sensor(s) employed on a test device to aid in determining golfer pre-swing rotation point locations may need to be of a totally different type(s) and/or placed at a different position(s) than that needed to aid in determining any equipment measurements during the actual performance period of a golf swing. Because of such required differences in features, test devices and/or the methods to produce test devices to help in determining sought after equipment and/or performer measurements existing only in the course of preparatory periods of activities are differentiated and patentably distinct from test devices made to help in determining the fit and measurement(s) of different sought after equipment and/or performer parameters existing during actual performances of the same activities.

In addition to the advancements concerning completed golf clubs and club measuring scales covered herein by the present invention, the waggle weight specification and other golf club specifications determined via the pre-swing can also be applied to develop new and improved designs of golf club components including club heads, shafts, and grips, as well as other club making and fitting devices/methods. And just as the unique pre-swing specification measurements of the present invention can also be applied to develop these other elements with respect to golf, so too can the unique preparatory period measurement(s) of the present invention be applied toward developing similar elements in the course of other determined activities.

Thus, it can be seen from the above descriptions, a waggle weight and other pre-swing specification measurements applied on a golf club, a computer-implemented process for locating a waggle weight point and/or other pre-swing measurements, a novel device having a fulcrum placed at a waggle weight point for determining a waggle weight and producing a golf club with a waggle weight, a method for generating at least one golf club with a waggle weight, and systems utilizing said specification, method, process, and device have been described. The application of the described aspects of the present invention culminates in a novel device of a golf club having a new/improved waggle weight specification measurement that helps to improve golfer performance. The unique features of the present invention may also be used to fit, measure, and produce equipment used by performers in other determined activities, where at least one equipment specification measurement used in a pre-determined activity is determined via movement and/or positioning of a performer during a preparatory period for the pre-determined activity. While the present invention has been related in terms of the foregoing embodiments, those skilled in the art should recognize that the invention is not limited to the embodiments depicted. The present invention can be practiced with modification and alteration within the spirit and scope of the appended claims. Thus, the description is to be regarded as illustrative instead of restrictive on the present invention.

What is claimed is:

1. A method of fitting an equipment measurement existing and measurable only during a preparatory period of a predetermined activity, comprising:

analyzing at least one preparatory movement or position of at least one performer or performer representation of a predetermined activity; and fitting at least one preparatory period equipment measurement via the analysis, whereby better equipment used in the performance of said predetermined activity can be produced using the at least one preparatory period measurement.

2. The method of claim 1, wherein the predetermined activity is golf and the at least one equipment measurement is a preparatory period golf club measurement.

3. The method of claim 1, wherein the predetermined activity is baseball and the at least one equipment measurement is a preparatory period baseball bat measurement.

4. The method of claim 1, wherein the at least one equipment measurement is a rotation point location disposed about at least one preparatory movement of said at least one performer or performer representation.

5. The method of claim 1, wherein said fit at least one preparatory period equipment measurement is used to fit at least one further equipment measurement via at least one performance analysis of said at least one performer or performer representation.

6. The method of claim 5, wherein at least one piece of equipment used in said predetermined activity is produced using the at least one fitted preparatory period equipment measurement or further fitted equipment measurement or at least one part of said equipment thereof is produced such that the at least one fitted equipment measurement is produced on said at least one piece of equipment.

7. The method of claim 1, wherein a computer-implemented process is produced or used to aid in determining the at least one equipment measurement.

8. The method of claim 6, wherein at least one device suitable for measuring said at least one preparatory period equipment measurement or further equipment measurement is produced or used to help in fitting said at least one equipment measurement or producing said at least one piece of equipment or part of said equipment thereof.

9. A method of producing a device to help fit at least one equipment measurement only existing during and measurable via an analysis of at least one preparatory movement or position of at least one performer or performer representation of a predetermined activity, comprising:

obtaining at least one sensor means suitable for providing an analysis of at least one predetermined equipment measurement existing and measurable during at least one preparatory movement or position of at least one performer or performer representation of a predetermined activity, and;

operably coupling said at least one sensor means to a device suitable for determining said at least one predetermined equipment measurement, whereby said method produces a device to help in fitting at least one equipment measurement existing and measurable only during at least one preparatory movement or position of at least one performer or performer representation of a predetermined activity.

10. The method of claim 9, wherein the at least one sensor means is portably coupled to said device.

11. The method of claim 9, wherein the at least one sensor means is permanently coupled to said device.

12. The method of claim 8, wherein said at least one device is a device suitable for measuring an equipment rotation point location only existing and measurable during said preparatory period.

13. The method of claim 8, wherein said at least one device is a scale with a fulcrum, the fulcrum placed at a location corresponding to a fit equipment rotation point location only existing and measurable during said preparatory period.

14. A method of fitting a golf club measurement existing and measurable only during a pre-swing, comprising:

analyzing at least one pre-swing movement or position of at least one golfer or golfer representation: and determining at least one pre-swing golf club measurement via the analysis, whereby a better golf club can be made using said at least one pre-swing measurement.

15. The method of claim 14, wherein a computer-implemented process is produced or used to help in determining the at least one pre-swing golf club measurement.

16. The method of claim 14, wherein said determined at least one pre-swing golf club measurement is used to determine at least one further golf club measurement via at least one performance analysis of said at least one golfer or golfer representation.

17. The method of claim 16, wherein at least one golf club is made using the at least one determined pre-swing golf club measurement or further golf club measurement or at least one golf club part thereof is made such that the at least one determined golf club measurement is produced on said at least one golf club.

18. The method of claim 17, wherein at least one device suitable for measuring said at least one pre-swing golf club measurement or further golf club measurement is produced or used to aid in determining said at least one golf club measurement or making said at least one golf club or golf club part thereof.

19. The method of claim 18, wherein said at least one device is a golf club, test golf club, or golf club substitute suitable for measuring a golf club rotation point location only existing and measurable during said pre-swing.

20. The method of claim 18, wherein said at least one device is a scale with a fulcrum, the fulcrum placed at a location corresponding to a determined golf club rotation point location only existing and measurable during said pre-swing.

* * * * *